United States Patent [19]

Ozaki et al.

[11] Patent Number: 4,788,134

[45] Date of Patent: Nov. 29, 1988

[54] HEAT-DEVELOPABLE PHOTOGRAPHIC LIGHT-SENSITIVE MATERIALS

[75] Inventors: Hiroyuki Ozaki; Ken Kawada, both of Kanagawa, Japan

[73] Assignee: Fuji Photo Film Co., Ltd., Kanagawa, Japan

[21] Appl. No.: 922,494

[22] Filed: Oct. 23, 1986

[30] Foreign Application Priority Data

Oct. 24, 1985 [JP] Japan ..... 60-238300

[51] Int. Cl.[4] ..... G03C 1/06; G03C 1/40

[52] U.S. Cl. ..... 430/619; 430/203; 430/562; 430/559; 430/351; 430/353

[58] Field of Search ..... 430/351, 353, 617, 619, 430/620, 203, 562, 559

[56] References Cited

U.S. PATENT DOCUMENTS

| | | | |
|---|---|---|---|
| 4,220,709 | 9/1980 | de Mauriac | 430/619 |
| 4,451,561 | 5/1984 | Hirabayashi et al. | 430/620 |
| 4,732,846 | 3/1988 | Aono et al. | 430/619 |

*Primary Examiner*—Won H. Louie

*Attorney, Agent, or Firm*—Sughrue, Mion, Zinn, Macpeak & Seas

[57] ABSTRACT

The present invention provides a heat-developable photographic light-sensitive material comprising, on a support, at least containing a light-sensitive silver halide, a binder, a reducing agent, and an organic silver salt, wherein said organic silver salt is a silver salt of a pyrazolazole-type compound represented by formula (I)

(I)

wherein $R^1$ and $R^2$ each represents a hydrogen atom or a substituent; Za, Zb, and Zc each represents a methine group, a substituted methine group, =N— or —NH—; and one of the Za-Zb bond and Zb-Zc bond is a double bond and the other is a single bond.

The present heat-developable photographic light-sensitive materials are capable of forming images of high density, with low fog, in a short period of time.

8 Claims, No Drawings

HEAT-DEVELOPABLE PHOTOGRAPHIC LIGHT-SENSITIVE MATERIALS

FIELD OF THE INVENTION

The present invention relates to heat-developable photographic light-sensitive materials containing a novel organic silver salt.

BACKGROUND OF THE INVENTION

Heat-developable photographic light-sensitive materials and image-formation processes using such materials have heretofore been well known, and are described, for example, in *The Fundamentals of Photographic Engineering* Corona Co., pp. 553–555, (1979)); *Image Information,* p. 40, (April, 1978); and Neblette's *Handbood of Photography and Reprography,* 7th ed., Van Nostrand Reinhold Company, pp. 32–33 (1977).

Typical organic silver salts which are usable in heat-developable photographic light-sensitive materials are silver salts of aliphatic carboxylic acids and those of aromatic carboxylic acids.

In addition, silver salts of aliphatic carboxylic acids having a thioether group, which are described in U.S. Pat. No. 3,330,663, are also usable.

However, these silver carboxylates are defective in that they release acids, after reacting with a reducing agent, to lower the pH value of the photographic film whereby the succeeding development is inhibited.

Other compounds having a mercapto group or a thione group and derivatives thereof are also known as usable organic silver salts.

In addition, silver salts of imino group-containing compounds are known to be usable, such as silver benzotriazoles and derivatives thereof, as described in Japanese Patent Publication Nos. 30270/69 and 18416/70.

However, these silver salts are defective in that they release, after reacting with a reducing agent, compounds that tend to inhibit development, or fog silver halides. Further, these often interfere with the action of spectral-sensitizing dyes to lower the sensitivity of the photographic materials.

SUMMARY OF THE INVENTION

An object of the present invention is to provide heat-developable photographic light-sensitive materials capable of forming images of high density with low fog in a short period of time.

In order to oattain the object, the present invention provides a heat-developable photographic light-sensitive material comprising, on a support, at least a light-sensitive silver halide, a binder, a reducing agent, and an organic silver salt, wherein said organic silver salt is a pyrazolazole-type compound represented by formula (I)

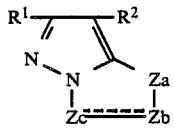

(I)

wherein $R^1$ and $R^2$ (which may be the same or different) each represents a hydrogen atom or a substituent; Za, Zb, and Zc each represents a methine group, a substituted methine group, =N— or —NH—, and one of the Za-Zb bond and the Zb-Zc bond is a double bond and the other is a single bond, (in case that the Zb-Zc bond is a carbon-carbon double bond, this may form a part of an aromatic ring).

DETAILED DESCRIPTION OF THE INVENTION $R_1$ and $R_2$ of formula (I) each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, a uredio group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

Among the pyrazoloazole-type compounds of formula (I), those of formulae (II), (III), IV), (V), (VI), (VII), and (VIII) are preferred

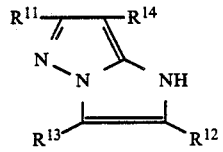

(II)

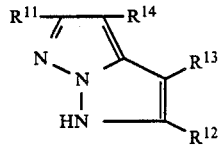

(III)

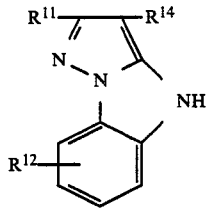

(IV)

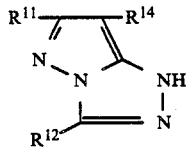

(V)

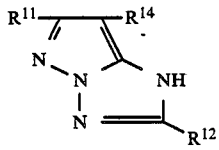

(VI)

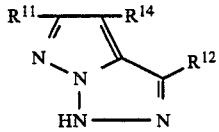

(VII)

-continued

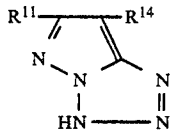

(VIII)

Among the compounds of formulae (II) through (VIII), those of formula (VI) are especially preferred for attaining the object of the present invention.

In formulae (II) through (VIII), $R^{11}$, $R^{12}$, $R^{13}$, and $R^{14}$ may be the same or different and each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

More particularly, $R^{11}$, $R^{12}$, $R^{13}$, and $R^{14}$ each represents a hydrogen atom, a halogen atom (such as chlorine atom or bromine atom), an alkyl group (such as methyl group, propyl group, t-butyl group, trifluoromethyl group, tridecyl group, 3-(2,4-di-t-amylphenoxy)propyl group, allyl group, 2-dodecyloxyethyl group, 3-phenoxypropyl group, 2-hexylsulfonyl-ethyl group, cyclopentyl group, or benzyl group), an aryl group (such as phenyl group, 4-t-butylphenyl group, 2,4'di-t-amylphenyl group, or 4-tetradecanamidophenyl group), a heterocyclic group (such as 2-furyl group, 2-thienyl group, 2-pyrimidinyl group, or 2-benzothiazolyl group), a cyano group, an alkoxy group (such as methoxy group, ethoxy group, 2-methoxyethoxy group, 2-dodecyloxyethoxy group, or 2-methanesulfonylethoxy group), an aryloxy group (such as a phenoxy group, 2-methylphenoxy group, or 4-t-butylphenoxy group), a heterocyclic-oxy group (such as 2-benzimidazolyloxy group), an acyloxy group (such as acetoxy group, hexadecanoyloxy group), a carbamoyloxy group (such as N-phenylcarbamoyloxy group or N-ethylcarbamoyloxy group), a silyloxy group (such as trimethylsilyloxy group), a sulfonyloxy group (such as dodecylsulfonyloxy group), an acylamino group (such as acetamido group, benzamido group, tetradecanamido group, α-(2,4-di-t-amylphenoxy)butylamido group, γ-(3-t-butyl-4-hydroxyphenoxy)butylamido group, or α-[4-(4-hydroxyphenylsulfonyl)phenoxy]decanamido group), an anilino group (such as phenylamino group, 2-chloroanilino group, 2-chloro-5-tetradecanamidanilino group, 2-chloro-5-dodecyloxycarbonylanilino group, N-acetylanilino group, 2-chloro-5-[α-(3-t-butyl-4-hydroxyphenoxy)dodecanamido]anilino group), a ureido group (such as phenylureido group, methylureido group, N,N-dibutylureido group), an imido group (such as N-succinimido group, 3-benzylhydantoinyl group, or 4-(2-ethylhexanoylamino)phthalimido group), a sulfamoylamino group (such as N,N-dipropylsulfamoylamino group or N-methyl-N-decylsulfamoylamino group), an alkylthio group (such as methylthio group, octylthio group, tetradecylthio group, 2-phenoxyethylthio group, 3-phenoxypropylthio group, or 3-(4-t-butylphenoxy)propylthio group), an arylthio group (such as phenylthio group, 2-butoxy-5-t-octylphenylthio group, 3-pentadecylphenylthio group, 2-carboxyphenylthio group, or 4-tetradecanamidophenylthio group), a heterocyclic-thio group (such as 2-benzothiazolythio group), an alkoxycarbonylamino group (such as methoxycarbonylamino group or tetradecyloxycarbonylamino group), an aryloxycarbonylamino group (such as phenoxycarbonylamino group or 2,4-di-tert-butylphenoxycarbonylamino group), a sulfonamido group (such as methanesulfonamido group, hexadecanesulfonamido group, benzenesulfonamido group, p-toluenesulfonamido group, octadecanesulfonamido group, or 2-methyloxy-5-t-butylbenzenesulfonamido group), a carbamoyl group (such as N-ethylcarbamoyl group, N,N-dibutylcarbamoyl group, N-(2-dodecyloxyethyl)carbamoyl group, N-methyl-N-dodecylcarbamoyl group, or N-[3-(2,4-di-tert-amylphenoxy)propyl]carbamoyl group), an acyl group (such as acetyl group, (2,4-di-tert-amylphenoxy)acetyl group, or benzoyl group), a sulfamoyl group (such as N-ethylsulfamoyl group, N,N-dipropylsulfamoyl group, N-(2-dodecyloxyethyl)sulfamoyl group, N-ethyl-N-dodecylsulfamoyl group, or N,N-diethylsulfamoyl group), a sulfonyl group (such as methanesulfonyl group, octanesulfonyl group, benzenesulfonyl group, or toluenesulfonyl group), a sulfinyl group (such as octanesulfinyl group, dodecylsulfinyl group, or phenylsulfinyl group), an alkoxycarbonyl group (such as methoxycarbonyl group, butyloxycarbonyl group, dodecyloxycarbonyl group, or octadecyloxycarbonyl group), or an aryloxycarbonyl group (such as phenyloxycarbonyl group or 3-pentadecyloxyphenoxycarbonyl group).

In formula (III), $R^{12}$ and $R^{13}$ may be bonded to each other to form a 5-membered to 7-membered ring.

Specific examples of the pyrazolazole-type compounds of formula (I), which constitute the silver salts of the compounds of the present invention, are shown below.

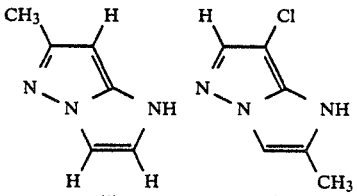

(1)

(2)

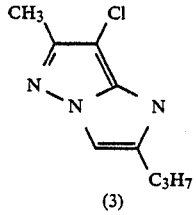

(3)

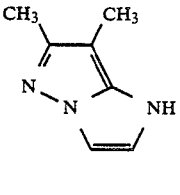

(4)

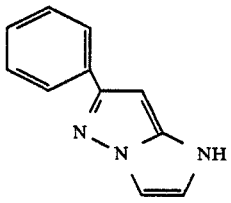

(5)

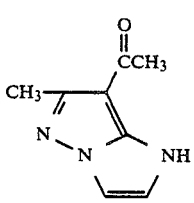

(6)

-continued
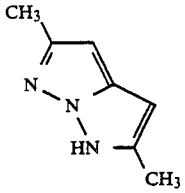
(7)
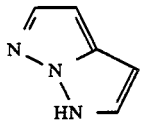
(8)
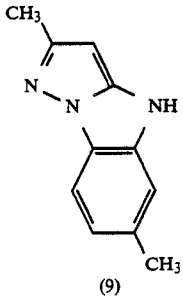
(9)
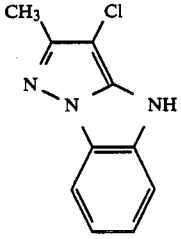
(10)
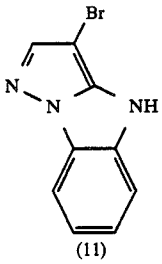
(11)
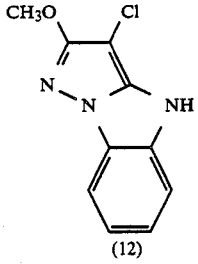
(12)
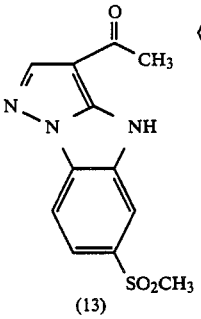
(13)
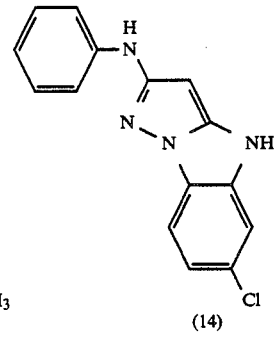
(14)
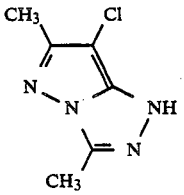
(15)
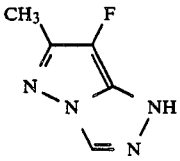
(16)
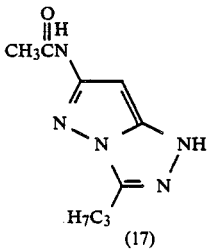
(17)
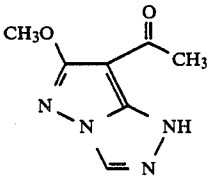
(18)
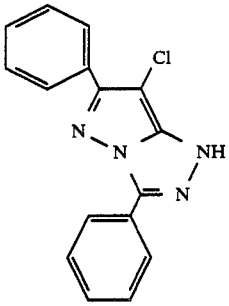
(19)
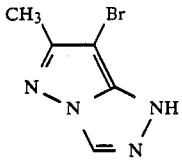
(20)
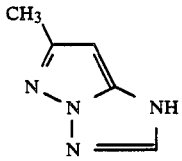
(21)
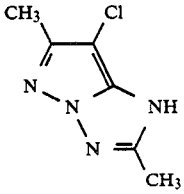
(22)
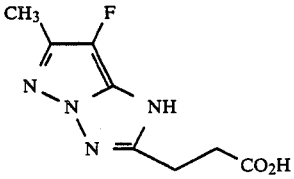
(23)
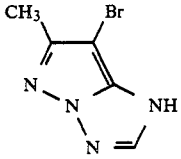
(24)
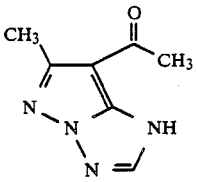
(25)
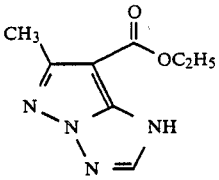
(26)
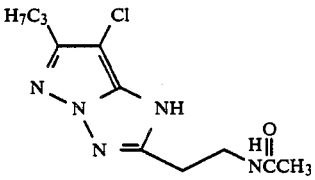
(27)
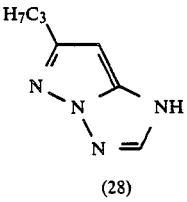
(28)
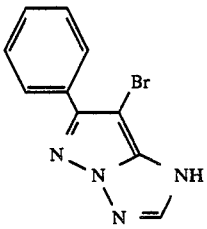
(29)
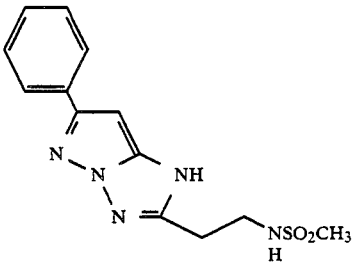
(30)

-continued

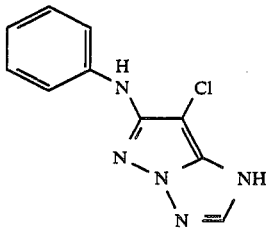

(31)

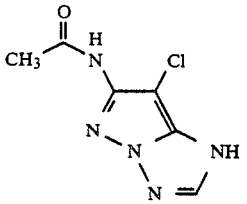

(32)

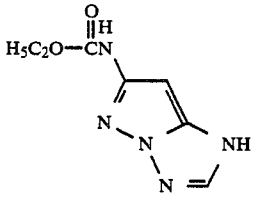

(33)

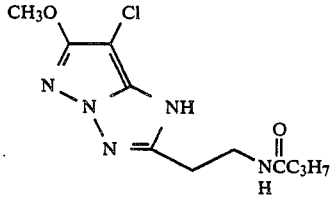

(34)

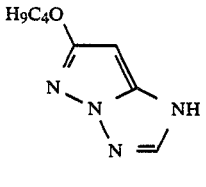

(35)

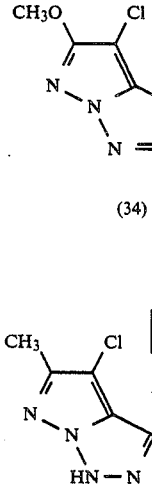

(36)

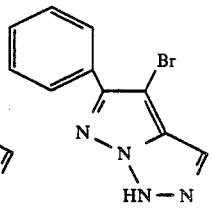

(37)

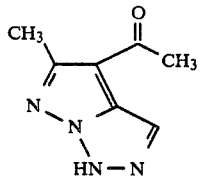

(38)

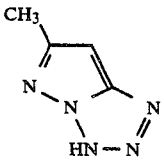

(39)

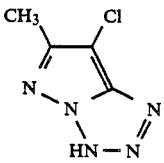

(40)

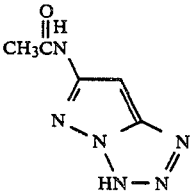

(41)

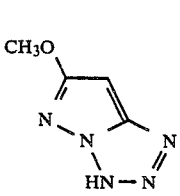

(42)

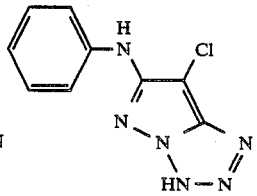

(43)

-continued

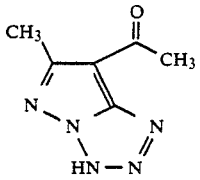

(44)

The pyrazolazole-type compound constituting the compounds of formula (I) of the present invention may be synthesized in accordance with the methods as described in the following publications.

The compounds of formulae (II) and (IV) are described in Japanese Patent Application (OPI) No. 162548/84; the compounds of formula (III) are in Japanese Patent Application (OPI) No. 43659/85 (the term "OPI" as used herein means as "unexamined published application."); the compounds of formula (V) are in Japanese Patent Publication No. 27411/72; the compounds of formula (VI) are in Japanese Patent Application (OPI) Nos. 171956/84 and 27745/84; the compounds of formula (VII) are in Japanese Patent Application (OPI) No. 33552/85; and the compounds of formula (VIII) are in U.S. Pat. No. 3,061,432.

The synthesis of the silver salts of these pyrazolazole-type compounds is described below.

The silver salts of the pyrazolazole-type compounds may be obtained, for example, merely by blending a silver ion source such as silver nitrate and the corresponding pyrazolazole-type compound in a hydrophilic solvent such as water and/or methanol. In this case, the components may be blended in the presence of a hydrophilic binder such as a gelatin. The purification of the resulting product or dispersion may be carried out in a conventional manner which is well known in this technical field.

The silver salts of thepyrazolazole-type compounds may be added to the photographic light-sensitive materials in the form of precursors which may be converted into the corresponding silver salts of the pyrazolazole-type compounds per se in the materials. For example, the silver salts of the pyrazolazlole-type compounds can be formed in the coating film of the photographic light-sensitive material in a process of adding the pyrazolazole-type compound of the coating solution and soaking the resulting coating film in an aqueous solution of silver nitrate.

The silver salts of the pyrazolazole-type compounds of the present invention may be prepared together with the other components of the heat-developable photographic light-sensitive materials in the same system, or alternatively may be prepared separately from the other components of the heat-developable photographic light-sensitive materials in a different system. From the viewpoint of easy control in the preparation of the salts and easy preservation of the salts, it is preferred to separately prepare the salts from the other components of the heat-developable photographic light-sensitive materials.

Two or more kinds of the silver salts of the pyrazolazole-type compounds of the present invention may be co-used in accordance with the present invention. Further, the present salts may be co-used together with other known organic silver salts. The silver salts of the pyrazolazole-type compounds of the present invention may be used together with the light-sensitive silver halide in the same layer or may be incorporated in the layer(s) adjacent to the silver halide-containing layer.

The range of the concentration of the silver salts of the pyrazolazole-type components of the present invention may be broad. For instance, the amount of the salts to be coated is generally suitably within the range of from 10 mg/m$^2$ to 10 g/m$^2$ as calculated in terms of the silver content therein. The amount is preferably from 0.01 to 200 moles per mole of the light-sensitive silver halide.

The shape and the particle size of the silver salts of the pyrazolazole-type compounds are not limited, but may be freely determined. The average particle size thereof is preferably 10 μm or less.

Organic compounds usable for the formation of the known organic silver salts which may be co-used together with the silver salts of the pyrazolazole-type compounds of the present invention are aliphatic or aromatic carboxylic acids, thiocarbonyl group-containing compounds which have a mercapto group or an α-hydrogen and imino group-containing compounds.

Typical examples of the silver salts of the aliphatic carboxylic acids are silver salts derived from behenic acid, stearic acid, oleic acid, lauric acid, capric acid, myristic acid, palmitic acid, maleic acid, fumaric acid, tartaric acid, furoic acid, linolic acid, linolenic acid, adipic acid, sebacic acid, succinic acid, acetic acid, bytyric acid, or camphoric acid. Further, silver salts derived from the derivatives of these fatty acids with a halogen or OH-substituent or from aliphatic carboxylic acids with a thioether group may also be used in the present invention.

Typical examples of the silver salts of the aromatic carboxylic acids and those of other carboxyl group-containing compounds are silver salts derived from benzoic acid, 3,5-dihydroxy-benzoic acid, o-, m-, or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, or 3-carboxymethyl-4-methyl-4-thiazoline-2-thione.

Typical examples of the silver salts of the mercapto group- or thiocarbonyl group-containing compounds are silver salts derived from 3-mercapto-4-phenyl-1,2,4-triazole, 2-mercaptobenzimidazole, 2-mercapto-5-aminothiadiazole, 2-mercaptobenzothiazle, S-alkylthioglycollic acids (where the alkyl group has from 12 to 22 carbon atoms), dithio-carboxylic acids such as dithioacetic acid, thioamides such as thiostearamide, 5-carboxy-1-methyl-2-phenyl-4-thiopyridine, or mercapto compounds as described in U.S. Pat. No. 4,123,274 such as mercaptotriazine, 2-mercaptobenzoxazole, mercaptoxadiazole, or 3-amino-5-benzylthio-1,2,4-triazole.

Typical examples of the silver salts of the imino group-containing compounds are silver salts derived from benzotriazoles or derivatives thereof as described in Japanese Patent Publication No. 30270/69 or 18416/70, for example, benzotriazole, alkyl-substituted benzotriazoles such as methylbenzotriazole, halogen-substituted benzotriazoles such as 5-chlorobenzotriazole or carbimidobenzotriazoles such as butylcarbimidobenzotriazole; and those derived from nitrobenzotriazoles as described in Japanese Patent Application (OPI) No. 118639/83; those derived from sulfobenzotriazoles, carboxybenzotriazoles and salts thereof, or hydroxybenzotriazoles as described in Japanese Patent Application (OPI) No. 118638/83; or those derived from 1,2,4-triazoles, 1H-tetrazoles, carbazoles, saccharins, imidazoles, and derivatives thereof as described in U.S. Pat. No. 4,220,709.

Further, the silver salts as described in *Research Disclosure,* Vol. 170, RD No. 17029 (June, 1978) as well as the silver salts of pyrolytic carboxylic acids such as phenylpropiolic acid as described in Japanese Patent Application (OPI) No. 113235/85 may also be used in the present invention.

The silver halides usable in the present invention may be anyone of silver chloride, silver bromide, siler chlorobromide, silver chloroiodide, or silver chloroiodobromide.

For instance, any of the silver halide emulsions as described in Japanese Patent Application (OPI) No. 107240/86, U.S. Pat. No. 4,500,626, and *Research Disclosure,* RD No. 17029, (June 1978) pp. 9–10 may be used.

The silver halide emulsions may be used without being post-ripened, but in general, are used after having been chemically-sensitized. Conventional means for the sensitization of emulsions of general photographic light-sensitive materials may be applied to the emulsions of the present invention; and for example, a known sulfur-sensitization method may be utilized, singly or in the form of a combination. The chemical-sensitization may be carried out in the presence of a nitrogen-containing heterocyclic compound, as described in Japanese Patent Application (OPI) Nos. 126526/83 and 215644/83.

The silver halide emulsions usable in the present invention may be either surface latent image-type emulsions capable of forming a latent image mainly on the surface of the particles or internal latent image-type emulsions capable for forming a latent image mainly in the interior of the particles. Direct reversal emulsions comprising the combination of the internal latent image-type emulsion and a nuclei-forming agent may also be used.

The amount of the light-sensitive silver halides to be coated in accordance with the present invention is within a range of from 1 mg/m$^2$ to 10 g/m$^2$, calculated in terms of the silver content therein.

The silver halides to be used in the present invention may be spectrally-sensitized with methine dyes or the like sensitizer dyes. Usable dyes include cyanine dyes, merocyanine dyes, complex cyanine dyes, complex merocyanine dyes, holopolar-cyanine dyes, hemicyanine dyes, styryl dyes, and hemioxonole dyes.

For instance, sensitizer dyes as described in Japanese Patent Application (OPI) Nos. 180550/84 and 140335/85, and *Research Disclosure,* RD No. 17029, pp. 12–13 as well as heat-discoloring sensitizer dyes as described in Japanese Patent Application (OPI) No. 111239/85 are mentioned.

The sensitizer dyes may be used singly or in the form of a combination of plural dyes. In particular, the combination of the sensitizer dyes is often utilized for the purpose of supersensitization of the emulsions.

Dyes which per se have no spectral-sensitizing ability or substances which do not substantially absorb any visible rays but have a spectral-sensitizing ability may be incorporated into the emulsions together with the sensitizer dyes. For example, compounds as described in U.S. Pat. Nos. 2,933,390, 3,635,721, 3,743,510, 3,615,613, 3,615,641, 3,617,295, and 3,635,721 are used therefor.

Regarding the time for the addition of the sensitizer dyes to the emulsions, the dyes may be added thereto during the chemical sensitization of the emulsions or before or after chemical sensitization, or before or after the formation of the nuclei of the silver halide particles.

The amount of the dyes to be added is about, in general, from $10^{-8}$ to $10^{-2}$ mole, per mole of the silver halide.

Silver may be used as the image-forming substance in the present invention. Further, compounds that may form or release a mobile dye, when a light-sensitive silver halide is reduced to silver under a high temperature condition, in correspondence or reverse correspondence with the reaction, or dye donor compounds, may also be used in the present invention.

The use of dye donor compounds is explained in more detail hereunder.

One example of the dye donor compounds usable in the present invention is, first of all, a coupler capable of reacting with a developing agent. The system to utilize the coupler is to form a dye by the reaction of an oxidized form of the developing agent, which results from the oxidation-reduction reaction of a silver salt and the developing agent, and the coupler, and this system is described in a lot of publications. The coupler may be either a tetra-equivalent coupler or a di-equivalent coupler. Di-equivalent couplers which have a nondiffusible group as a cleavage group and which may form a diffusible dye by the reaction with an oxidized form of a developing agent are preferred. Concrete examples of the developing agents and the couplers are described in detail, for example, in T. H. James, *The Theory of the Photographic Process,* 4th Ed., Macmillan Publishing Co., 1977) pp. 291–334 and pp. 354–361 and in Japanese Patent Application (OPI) Nos. 123533/83, 149046/83, 149047/83, 111148/84, 124399/84, 174835/84, 231539/84, 231540/84, 2950/85, 2951/85, 14242/85, 23474/85, and 66249/85.

A silver dye compound comprising the combination of an organic silver salt and a dye is an example of the dye donor compounds. Concrete examples of the silver dye compounds are described, for example, in *Research Disclosure,* Vol. 169, RD No. 16966 (May, 1973), pp. 54–58.

The azo dye that is used in the heat-developable silver dye bleaching method can also be described as an example of said dye donor compound. Specific examples of such azo dyes and the bleaching technique are described in U.S. Pat. No. 4,235,957 and *Research Disclosure,* Vol. 144, RD No. 14433 (April, 1976), pp. 30–32, among others. The leuco dyes described in U.S. Pat. Nos. 3,985,565 and 4,022,617, for instance, can also be considered as dye donor compounds.

A further example of the dye donor compound includes a compound adapted to imagewise release or spread a diffusible dye. Compounds of such type can be represented by formula ($L_1$)

$$(\text{Dye-X})_n\text{-Y} \qquad (L_1)$$

wherein Dye represents a dye group or a dye group or a dye precursor group whose wavelength is shortened temporarily; X represents a chemical bond or a divalent linking group; and Y represents a group which either causes an imagewise differential in the diffusibility of the compound $(\text{Dye-X})_n$-Y in correspondence or reverse correspondence with the photosensitive silver salt carrying a latent image or releases the Dye and causes a differential in diffusibility between the released Dye and $(\text{Dye-X})_n$-Y; n represents 1 or 2 and when n is equal to 2, the two Dye-X groups may be the same or different.

The dye donor compound of formula ($L_1$) is exemplified by the dye developer consisting of a hydroquinone type developer component and a dye component which is described in U.S. Pat. Nos. 3,134,764, 3,362,819, 3,597,200, 3,544,545, and 3,482,972, for instance. The compounds which release diffusible dyes through intermolecular nucleophilic substitution reaction are described in Japanese Patent Applicaion (OPI) No. 63618/76, among others, and the compounds which release diffusible dyes through a manner of winding inside the molecule of isooxazolones are described in Japanese Patent Application (OPI) No. 111628/74, for instance. These systems are invariably such that a diffusible dye is released or spread in undeveloped areas and not released or spread in developed areas.

As an alternative system, there has been developed a system in which a dye releasing compound is made into an oxidized form which has no dye-releasing property and allowed to be present concomitantly with a reducing agent or a precursor thereof, and after development, is reduced by the residual unoxidized reducing agent so as to release a diffusible dye. Specific examples of the dye donor compounds used in this system are set forth in Japanese Patent Application (OPI) Nos. 110827/78, 130927/79, 164342/81, and 35533/78 among others.

On the other hand, as the substance which releases a diffusible dye in the developed areas, the substance which releases a diffusible dye through reaction of a coupler moiety having the diffusible dye as a cleavage group with an oxidized developing agent is described in British Pat. No. 1,330,524, Japanese Patent Publication No. 39165/73, and U.S. Pat. No. 3,443,940.

In these systems employing such color developers, the image spoilage by the oxidation products of a developing agent presents a serious problem, and, to obtain improvements in this respect, there have been developed dye donor compounds which do not require a developing agent, but rather have a reducing property per se.

Typical examples of such dye donor compounds are described, for example, in U.S. Pat. Nos. 3,982,312, 4,053,312, 4,055,428, 4,336,322, 3,725,062, 3,728,113, 3,443,939 and 4,500,626, Japanese Patent Application (OPI) Nos. 65839/84, 39839/84, 3819/78, 104343/76, 116537/83, and 179840/82, *Research Disclosure, Vol.* 174, RD No. 17465 (October, 1978).

Specific examples of the dye donor compound that can be employed in the present invention are set forth in U.S. Pat. No. 4,500,626 noted above. Particularly preferred species are the compounds (1) to (3), (10) to (13), (16) to (19), (28) to (30), (33) to (35), (38) to (40), and (42) to (64) as described in the above-mentioned U.S. Pat. No. 4,500,626. Further, the compounds described in Japanese Patent Application (OPI) No. 124941/86 are also useful.

The dye donor compounds and hydrophobic additives such as an image formation accelerator that are employed in accordance with the present invention can be incorporated into layers of the photosensitive material by known procedures, including the method described in U.S. Pat. No. 2,322,027. In such procedures, the high-boiling point organic solvents described in Japanese Patent Application (OPI) Nos. 83154/84, 178451/84, 178452/84, 178453/84, 178454/84, 178455/84, and 178457/84 and low-boiling point organic solvents having a boiling point of from 50° C. to 160° C. can be employed, if desired.

The amount of the high-boiling organic solvents to be used is 10 g or less, and preferably 5 g or less, per one gram of the dye donor compound as used.

Dispersing methods using polymers as described in Japanese Patent Publication No. 39853/76 and Japanese Patent Appliction (OPI) No. 59943/76 can be utilized.

For the incorporation of compounds which are substantially insoluble in water, the compounds may be dispersed in a binder in the form of fine particles and the resulting dispersion can be incorporated into the layers, in place of the above-described means.

When the hydrophobic substance is dispersed in a hydrophilic colloid, various kinds of surfactants can be used, and examples of the usable surfactants are described, for example, in Japanese Patent Application (OPI) No. 157636/84.

In the practice of the present invention, a reducing substance is preferably incorporated in the photographic light-sensitive materials. Usable reducing agents include conventional reducing agents and additionally the aforesaid dye donor compounds having a reducing property. Further, reducing agent precursors may also be used, which per se do not have any reducing property, but which may become reductive by the action of the nucleophilic reagent or heat in the development procedure.

Examples of the reducing agents which may be used in the present invention are described, for example, in U.S. Pat. Nos. 4,500,626 and 4,483,914 and Japanese Patent Application (OPI) Nos. 140335/85, 128438/85, 128436/85, 128439/85, and 128437/85. Further, reducing agent precursors as described in Japanese patent Application (OPI) Nos. 138736/81 and 40245/82 and U.S. Pat. No. 4,330,671 may also be used in the present invention.

The combinations of various developing agents as described in U.S. Pat. No. 3,039,639 may further be utilized in the present invention.

The amount of the reducing agent to be used in accordance with the present invention is generally from 0.01 to 20 moles, and especially preferably from 0.1 to 10 moles, per mole of silver.

In the practice of the present invention, an image formation accelerator can be used in the photosensitive material. The image formation accelerators include those which promote the redox reaction between the silver salt oxidizing agent and the reducing agent, those which promote formation of a dye from a dye donor substance, or decomposition of a dye, and those which promote various reactions such as the release of a mobile dye, and those which accelerate the migration of a dye from a photosensitive layer to a dye fixing layer. Classified by physicochemical function, the image formation accelerators can be classified into bases or base precursors, nucleophilic compounds, high boiling point organic solvents (oils), thermal solvents, surfactants, and compounds which interact with silver or silver ions, for instance. However, each of these substances generally has plural functions and provides several of the above-mentioned effects. A detailed description on these substances and their functions is set forth in U.S. Pat. No. 4,500,626.

Apart from the use of the above-mentioned image formation accelerator, there have been known some other methods for the generation of bases, and the compounds to be used in these methods are useful in the present invention as base precursors. For instance, the formation of bases by the admixture of a hardly soluble metal compound and a compound which may react with the metal ion constituting the hardly soluble metal compound for the chain formation (which is called a chain-forming compound); and the formation of bases by electrolysis, may be adapted to the practice of the present invention.

In particular, the former means is effective. The hardly soluble metal compounds include zinc, aluminium calcium or barium carbonates, hydroxides, or oxides. The chain-forming compounds are described in detail, for example, in A. E. Martel and R. M. Smith, *Critical Stability Constants* (Plenum Press), Vols. 4 and 5. Concrete examples of the compounds are alkali metal, guanidine, amidine, or quaternary ammonium salts of amino-carboxylic acids, imidino-acetic acids, pyridyl-carboxylic acids, amino-phosphoric acids, carboxylic acid (including mono-, di-, tri-, and tetra-carboxylic acids as well as derivatives with a substituent of phosphono, hydroxy, oxo, ester, amido, alkoxy, mercapto, alkylthio, or phosphino group), hydroxamic acids, polyacrylates, or polyphosphoric acids.

The hardly soluble metal salt and the chain-forming compound are advantageously separately added to the light-sensitive material and the dye-fixing material.

In the practice of the present invention, various development terminating agents can be used in the photosensitive material for the purpose of ensuring a constant image quality irrespective of variations in the thermal development temperature or processing time.

The terminology "development terminating agent" as used herein means a compound which, after proper development, quickly neutralizes the base or reacts with the base to lower the base concentration in the layer and thereby terminates the development, or a compound which interacts with silver and silver salt to arrest development. Examples of such componds are acid precursors capable of releasing an acid under heat, electrophilic compounds to cause a substitution reation with a co-existing base under heat, nitrogen-containing heterocyclic compounds and mercapto compounds and precursors thereof. (For example, compounds as described in Japanese Patent Application (OPI) Nos. 108837/85, 192939/85, 230133/85, and 230134/85 are mentioned.)

Further, compounds capable of releasing a mercapto compound under heat are usable, which are described, for example, in Japanese Patent Application (OPI) Nos. 167851/86, 147244/86, 124941/86, 185743/86, 182039/86, 185744/86, 184539/86, 188540/86 and 53632/86.

In carrying the present invention into practice, a compound which activates development, and, at the same time, serves to stabilize the image, can further be incorporated in the photosensitive material. Concrete compounds which are preferably used in the present invention are described in U.S. Pat. No. 4,500,626.

Various kinds of fog-inhibitors may be used in the practice of the present invention. Examples of usable fog-inhibitors include azoles, nitrogen-containing carboxylic acids and phosphoric acids as described in Japanese Patent Application (OPI) No. 168442/84, mercapto compounds and metal salts thereof as described in Japanese Patent Application (OPI) No. 111636/84, and acetylene compounds as described in Japanese Patent Publication No. 22067/64.

In the practice of the present invention, an image toner can be incorporated in the photosensitive material. Useful examples of the toners are described in Japanese Patent Application (OPI) No 147244/86.

The binder used in the photosensitive material according to the present invention may be a single binder or a combination of two or more binders. Hydrophilic binders can be utilized and typical examples of such binders are transparent or translucent binders. More specifically, natural substances such as proteins, e.g., gelatin, gelatin derivatives, etc., and polysaccharides, e.g., cellulose derivatives, starch, gum arabic, etc., and synthetic polymers such as water-soluble polyvinyl compounds, e.g., polyvinyl pyrrolidone, polyacrylamide, and so on. Among other synthetic polymers that can be used are dispersible vinyl compounds in latex form which contribute to the dimensional stability of photographic materials.

In accordance with the present invention, the binder is used in a coverage of 20 g/m$^2$ or less, preferably in a coverage not exceeding 10 g per m$^2$, and for still better results, not more than 7 g/m$^2$.

The proportion of the high boiling point organic solvent which is dispersed together with the hydrophobic compound such as said dye honor compound in the binder is not more than 1 cc to each per gram of the binder, preferably not more than 0.5 cc per gram of the binder, and for still better results, not more than 0.3 cc on the same basis.

In the photographic light-sensitive element and dye-fixing element in accordance with the present invention, either an inorganic hardener or an organic hardener can be incorporated in the photographic emulsion layer and/or other binder layer.

Specific examples of the hardeners are set forth in Japanese Patent Application (OPI) Nos. 147244/86 and 157636/84 and these compounds can be used singly or in combination.

The support which is used in the light-sensitive element, and, depending on the intended application, in the dye-fixing element as well, may be any support that withstands the processing temperature. As the support materials, glass, paper, polymer film, metal, and other analogous materials can be employed and those described as support materials in Japanese Patent Application (OPI) No. 147244/86 can also be utilized.

When a colored dye donor compound is contained in the light-sensitive material used in the practice of the present inventon, it is not so necessary to incorporate an anti-irradiation or anti-halation agent and/or other dyes in the light-sensitive material but the filter dyes and absorbent substances as described in the publications which are referred to in Japanese Patent Application (OPI) No. 147244/86 and U.S. Pat. No. 4,500,626 can be incorporated therein.

The light-sensitive element used in accordance with the present invention for the purpose of obtaining a broad range of color within the color chart using as the three primary color of yellow, magenta, and cyan must have at least three silver halide emulsion layers having different spectral sensitivities.

Representative combinations of at least three silver halide emulsion layers having different spectral sensitivities are described in Japanese Patent Application (OPI) No. 180550/84.

The light-sensitive material used in the practice of the present invention may comprise, as required, two or more distinct emulsion layers of the same spectral sensitivities, but having different speeds.

The light-sensitive material employed in the present invention may contain, if desired, various additives known in the art of photothermography and also include varius layers other than light-sensitive layers, such as an antistatic layer, conductive layer, protective layer, intermediate layer, anti-halation layer, separating layer, matting layer, and so on which are known in the art. Examples of additives include the additives described in *Research Disclosure, Vol.* 170, RD No. 17029 (June, 1978), pp. 9-15 and U.S. Pat. No. 4,500,626, such as plasticizers, sharpness improving dyes, anti-halation (AH) dyes, sensitizer dyes, matting agents, surfactants, fluorescent whiteners, ultraviolet-absorbents, slide-inhibitory agents, antioxidants, anti-fading agents, etc.

Particularly, in the protective layer, it is common practice to incorporate an organic or inorganic matting agent, for prevention of adhesion. Further, a mordant, an altraviolet absorbent and the like may also be incorporated in this protective layer. The protective layer and intermediate layer may each consist of two or more units.

In the intermediate layer may be incorporated a reducing agent, a UV-absorbent and/or a white pigment such as $TiO_2$ for the prevention of discoloration or color-stain. The white pigment may be added not only to the intermediate layer, but also to the emulsion layers for increased sensitivity.

The photographic elements of the present invention comprise a light-sensitive element for forming or releasing a dye by heat-development and optionally a dye-fixing element for fixing the dye.

Particularly, in a system where an image is formed by the diffusion transfer of a dye, both of such light-sensitive element and dye-fixing element are necessary, and the system may be classified into two major categories, a format in which the light-sensitive element and the dye-fixing element are respectively disposed on two independent supports and a format in which the two elements are provided as coating layers on one and the same support.

As regards the relation between the dye element and dye-fixing element, the relation thereof to the support and the relation thereof to the white reflective layer, those described in Japanese Patent Application (OPI) No. 147244/86 and U.S. Pat. No. 4,500,626 are applicable to the present invention.

Representative of the format in which the light-sensitive element and dye-fixing element are coated on the same support is the format in which the light-sensitive element need not be separated from the dye-fixing element after formation of the transferred image. In this system, the light-sensitive layer, dye-fixing layer, and white reflective layer are disposed in superimposition on a transparent or opaque support. Some preferred embodiments of the format are, for example, transparent support/light-sensitive layer/white reflective layer/dye-fixing layer; transparent support/dye-fixing layer/white reflective layer/light-sensitive layer, and the like.

Another representative format in which the light-sensitive element and dye-fixing element are disposed on the same support is a format which is designed so as to peel a part or all of the light-sensitive element from the dye-fixing element, as described in Japanese Patent Application (OPI) No. 67840/8, Canadian Pat. No. 674,082 and U.S. Pat. No. 3,730,718, for instance. In this format, a separating layer is appropriately provided on the support.

The light-sensitive element or the dye-fixing element may comprise a conductive heat element-containing layer as a heating means for heat-development or diffusion transfer or the dye.

A transparent or opaque heat element in this system may be formed by the utilization of a conventional technique which is known in the field of formation of conventional heat elements.

Examples of the formation of the heat elements include a method using a thin layer of a semi-conductive inorganic material and a method using an organic thin layer comprising a dispersion of conductive fine particles as dispersed in a binder. Materials usable in these methods are described in Japanese Patent Application (OPI) No. 29835/86.

The dye-fixing element used in accordance with the present invention has at least one layer containing a mordant, and in a format in which the dye-fixing layer is disposed on the surface, a further protective layer may be provided, if desired.

With regard to the layer construction, binder and additives of the dye-fixing element as well as the position of the mordant-containing layer in the element, those described in Japanese Patent Application (OPI) No. 147244/86 and in patent publications as referred to in said Application are applicable to the present invention.

The dye-fixing element used in the practice of the present invention may have separating, matting, anti-curling, and other auxiliary layers, if desired, in addition to the above-mentioned layers.

In one or more layers among the above-mentioned layers, there may also be incorporated a base and/or a base precursor for promoting migration of the dye, a hydrophilic thermal solvent, an anti-fading agent for preventing discoloration, a UV-absorbent, a smoothing agent, a matting agent, an anti-oxidant, a vinyl compound dispersion for increasing dimensional stability, a fluorescent whitener, and so on. Examples of these additives are described in U.S. Pat. No. 4,500,626.

The binder to be used in the above-mentioned layers is preferably a hydrophilic binder, which is exemplified by transparent and translucent hydrophilic colloids. More specifically, the binders mentioned hereinbefore in connection with the light-sensitive element may be employed.

Regarding the image-receiving layer according to the present invention, it may be a dye-fixing layer used in a heat-developable color photosensitive materials, and while a choice may be made from among the mordants commonly used, polymeric mordants are particularly preferred. The expression "polymeric mordant" is used herein to mean any of tertiary amino group-containing polymers, nitrogen-containing heterocyclic ring-containing polymers, and the corresponding quaternary cation group-containing polymers.

Specific examples of the polymers are described, for example, in Japanese patent application (OPI) No. 147244/86 and U.S. Pat. No. 4,500,626.

In accordance with the present invention, the coating layer, a protective layer, an intermediate layer, a subbing layer, a backing layer, etc. can be as those described in U.S. Pat. No. 4,500,626.

As the light source for imagewise exposure for recording an image on the heat-developable light-sensitive material, various radiations including light in the visible region can be employed, and, for example, the sources of light described in Japanese patent application (OPI) No. 147244/86 and U.S. Pat. No. 4,500,626 can be utilized.

Regarding the heating temperature used in the heat-development process, the development can be effected at a temperature from about 50° C. to about 250° C., and particularly useful temperature range is from about 80° C. to about 180° C. The heating temperature in the transfer process may range from the development temperature to room temperature, but it is preferable to use a higher temperature from 50° C. up to a temperature lower than the development temperature by about 10° C. As the heating means for use in the development process and/or the transfer process, use may be made of various means such as a hot plate, an iron, a thermal roller, a heating element utilizing carbon or titanium white, and so on.

Further, as described in detail in Japanese patent application (OPI) No. 218443/84 and Japanese patent application No. 79709/85, the method in which development and transfer are carried out either at the same time or in a continuous sequence under heat in the presence of a small amount of a solvent such as water can be advantageously utilized. In this method, the above-mentioned image formation accelerator may be previously incorporated in either one or both of the dye-fixing material and the light-sensitive material or supplied from the outside.

In the system where development and transfer are carried out simultaneously or in a continuous sequence, the heating temperature is preferably higher than 50° C. and lower than the boiling point of the solvent used for the transfer process. For example, when the transfer solvent is water, a temperature between 50° C. and 100° C. is preferred.

A solvent may be used for the migration of the mobile dye to the dye-fixing layer.

Examples of solvents usable for the acceleration of the development and/or the migration of the mobile dye to the dye-fixing layer include water and a basic aqueous solution containing an inorganic alkali metal salt or an organic base. For the bases, those as described hereinbefore in connection with the image formation accelerators are usable. In addition, low boiling point solvents and mixed solvents comprising a low boiling point solvent and water or a basic aqueous solution may also be usable. The solvents may contain a surfactant, an anti-fogging agent, a mixture of a hardly soluble metal salt and a complex-forming compound, and so on.

The solvents may be added to either one or both of the dye-fixing material and the light-sensitive material. The amount thereof to be added may be equal or less than the weight of the solvent which corresponds to the maximum swollen volume of the total coated layer (especially to the weight or less of the solvent which corresponds to the amount as obtained by subtracting the weight of the total coated layer from the weight of the solvent corresponding to the maximum swollen volume of the total coated layer).

The solvent (for example, water) is generally spread between the light-sensitive layer of the heat-developable light-sensitive material and the dye-fixing layer of the dye-fixing material, to thereby accelerate the formation of the image and/or the transfer of the dye, but it is possible to previously incorporate the solvent in the light-sensitive layer, the dye-fixing layer, or both thereof.

Methods for applying the solvent to the light-sensitive layer or the dye-fixing layer are described, for example, in Japanese patent application (OPI) No. 147244/86.

For the acceleration of the migration of the dye, a system to incorporate a hydrophilic thermal solvent which is solid at room temperature but may melt at a higher temperature into the light-sensitive material or the dye-fixing material may be applicable to the present invention. The hydrophilic thermal solvent may be incorporated in any of the light-sensitive material, the dye-fixing material, or in both thereof. In the incorporation of the solvent, the solvent may be incorporated in any of the emulsion layer, intermediate layer, protective layer, and dye-fixing layer, and it is preferred to incorporate the solvent into the dye-fixing layer and/or the adjacent layer(s).

Examples of the hydrophilic thermal solvents are ureas, pyridines, amides, sulfonamides, imides, alcohols, oximes, and other heterocyclic compounds.

For the heating means in the transfer process, the means as described in Japanese patent application (OPI) No. 147244/86 may be utilized. As an alternative, one may superimpose a conductive layer of graphite, carbon black, or metal on the dye-fixing material, and pass an electric current through the conductive layer, so as to directly heat the system.

The pressure conditions and methods for applying the pressure that can be used in attaching and closely adhering the heat-developable light-sensitive material to the dye-fixing material are described, for example, in Japanese patent application (OPI) No. 147244/86.

The effect of the present invention is apparent from the explanation as given above and from the examples which are set forth hereinafter. In particular, the heat-developable photographic light-sensitive materials of the present invention containing the silver salt of the pyrazolazole-type compound of formula (I) can form images of high density with low fog in a short period of time.

The present invention is explained in greater detail by reference to the following examples, which, however, are not intended to be interpreted as limiting the scope of the present invention.

EXAMPLE 1

This illustrates the preparation of dispersions containing a silver salt of the compound of the present invention.

20 g of gelatin and 5.0 g of the compound No. (22) were dissolved in 100 ml of water and 400 ml of ethanol.

The resulting solution was stirred while being kept at 40° C.

A solution of 4.5 g of silver nitrate as dissolved in 200 ml of water was added to the said solution in the course of 10 minutes.

The pH of the resulting dispersion was properly regulated for sedimentation to remove the excess salt. Afterwards, the pH was adjusted to 6.4 and a dispersion of a silver salt (Z-1) of the compound (22) was obtained. The yield of the dispersion was 300 g.

In the same manner as above, dispersions of silver salts (Z-2), (Z-3), and (Z-4) of the compound Nos. (10), (15), and (39), respectively, were obtained.

Next, the preparation of a silver benzotriazole emulsion is described hereunder.

28 g of gelatin and 13.2 g of benzotriazole were dissolved in 300 ml of water. The resulting solution was stirred while being kept at 40° C. To this was added a solution of 17 g of silver nitrate as dissolved in 100 ml of water in the course of 2 minutes.

The pH of the resulting silver benzotriazole emulsion was properly regulated for sedimentation to remove the excess salt. Afterwards, the pH was adjusted to 6.30 to obtain 400 g of the aimed silver benzotriazole emulsion.

Next, the preparation of a silver halide emulsion is described hereunder.

600 ml of an aqueous solution containing sodium chloride and potassium bromide and a silver nitrate-aqueous solution (prepared by dissolving 0.59 mole of silver nitrate in 600 ml of water) were added at the same time to a well-stirred gelatin-aqueous solution (prepared by dissolving 20 g of gelatin and 3 g of sodium chloride in 1000 ml of water and kept at 75° C.), in the course of 40 minutes and at the same flow speed. Thus, a monodisperse cubic silver chlorobromide emulsion (bromine content: 80 mole%) having an average particle size of 0.35 μm was obtained.

After washed with water and demineralized, 5 mg of sodium thiosulfate and 20 mg of 4-hydroxy-6-methyl-1,3,3a,7-tetrazaindene were added to the emulsion and chemically-sensitized at 60° C. The yield of the emulsion was 600 g.

Next, the preparation of a gelatin-dispersion containing a dye donor compound is described hereunder.

5 g of magenta-dye donor compound (A), 0.5 g of 2-ethylhexyl succinate-sodium sulfonate (as a surfactant) and 10 g of tri-isononyl phosphate were weighed, and 30 ml of ethyl acetate was added thereto and dissolved under heat at about 60° C. to obtain a uniform solution. The resulting solution was blended with 100 g of 10%-solution of a lime-treated gelatin, while stirred, and then the resulting mixture was homogenized in a homogenizer for 10 minutes at a rotation speed of 10,000 rpm to obtain a dispersion. This dispersion was called a magenta-dye donor dispersion.

(A)

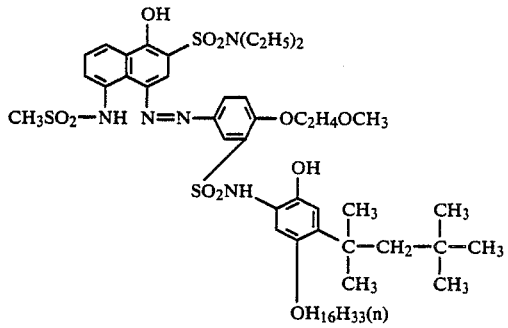

Next, the preparation of a light-sensitive material with a coated film is described hereunder.

| | | |
|---|---|---|
| (a) | Silver benzotriazole emulsion | 10 g |
| (b) | Light-sensitive silver chlorobromide emulsion | 15 g |
| (c) | Dye donor dispersion | 25 g |
| (d) | 5%-aqueous solution of the following compound: | 5 ml |

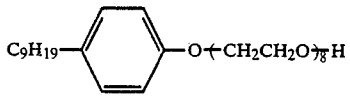

| | | |
|---|---|---|
| (e) | 10%-methanol solution containing benzenesulfonamide | 5 ml |
| (f) | 0.04%-methanol solution containing the following dye: | 4 ml |

-continued

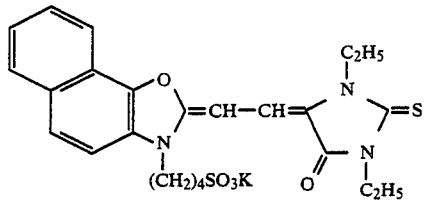

The above (a) through (f) were blended and a tackifier and water were added thereto to obtain a solution of 100 ml. The resulting solution was coated on a polyethylene terephthalate film having a thickness of 180 μm, to form a coated film thereon having a wet film thickness of 50 μm.

Next, a coating composition for a protective layer was prepared by mixing the following components.

| | |
|---|---|
| (g) 10%-gelatin | 400 g |
| (h) Basic zinc carbonate (10%-aqueous dispersion) | 150 g |
| (i) 4%-aqueous solution of the following hardener: $CH_2{=}CH{-}SO_2CH_2CONH{-}(CH_2)_2{-}NHCOCH_2SO_2{-}CH{=}CH_2$ | 50 ml |

The above (g) through (i) were blended and a tackifier and water were added thereto to obtain a solution of 1,000 ml. The thus obtained coating composition was superposed on the previously coated light-sensitive layer to form a protective layer thereon having a thickness of 30 μm.

The light-sensitive material thus obtained was labeled light-sensitive material Sample No. (101).

In the same manner as the preparation of Sample No. (101) with the exception that the silver salt (Z-1) of the present compound was added in place of the silver benzotriazole emulsion in Sample No. (101), the amount of the coated silver being the same one, another light-sensitive material Sample No. (102) was obtained.

Also in the same manner were prepared still other light-sensitive material Sample Nos. (103), (104), and (105) where the silver salts (Z-2), (Z-3), and (Z-4) were used, respectively, in place of the silver benzotriazole emulsion in Sample No. (101).

Next, the preparation of dye-fixing material (D-1) having an image-receiving layer is described hereunder.

9 g of a polymer having the following structural formula was dissolved in 130 ml of water, and the resulting solution was uniformly blended with 50 g of a 10%-lime-treated gelatin, 5 g of dextran (average molecular weight: 59,000), and 7.6 g of guanidine picolinate. The resulting mixture solution was uniformly coated on a paper support as laminated with a titanium dioxide dispersion-containing polyethylene to form a film having a wet thickness of 55 μm.

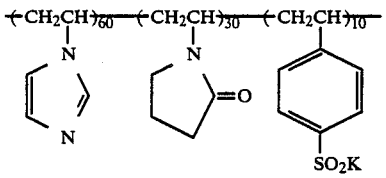

1.5 g of gelatin-hardener (H-1), 0.5 g of gelatin-hardener (H-2), 130 ml of water and 70 g of 10%-lime-treated gelatin were uniformly blended, and the resulting mixture was uniformly superposed on the previously coated film to form a film thereon having a wet film thickness of 20 m. The sample was dried to obtain the dye-fixing material sample (D-1).

Gelatin-hardener (H-1)

$CH_2{=}CH{-}SO_2CH_2CONHCH_2NHCOCH_2SO_2CH{=}CH_2$

Gelatin-hardener (H-2)

$CH_2{=}CH{-}SO_2CH_2CONHCH_2CH_2CH_2NHCOCH_2SO_2CH{=}CH_2$

The light-sensitive material sample was imagewise exposed with a tungsten lamp at 2,000 lux for one second through a green filter, which is an interference filter having a maximal transmittance at 560 nm and having a half value width of 50 nm, produced by Fuji Photo Film Co., Ltd.

20 ml/m$^2$ of water was applied to the surface of the emulsion layer of the thus exposed sample with a wire-bar, and then this was attached to the dye-fixing material sample whereupon the surfaces of the coated films of both samples faced each other. This was heated with a heat-roller for 20 seconds while the temperature of the wetted film was regulated to be from 90° to 95° C., and thereafter, the dye-fixing material was peeled off from the light-sensitive material. Thus, a sharp magenta dye was formed on the dye-fixing material. The maximum density and the minimum density of the image were measured with a Macbeth Reflection Densitometer (RD-519). The results are shown in the following Table 1.

TABLE 1

| Sample No. | Silver Salt | Maximum Density | Minimum Density |
|---|---|---|---|
| 101* | Silver benzotriazole | 1.65 | 0.11 |
| 102 | Z-1 | 2.27 | 0.14 |
| 103 | Z-2 | 2.11 | 0.13 |
| 104 | Z-3 | 2.13 | 0.14 |
| 105 | Z-4 | 2.17 | 0.15 |

*comparative sample

The results in above Table 1 prove that the light-sensitive materials containing the silver salt of the pyrazolazole-type compound of the present invention rapidly form images of high density with low fog.

EXAMPLE 2

The same light-sensitive layer-coated materials as the previous Example 1 were used, while the basic zinc carbonate was not added to the protective layer composition. Thus, light-sensitive material Sample Nos. (201), (202), (203), (204), and (205) were formed.

Next, the preparation of dye-fixing material sampel (D-2) is described hereunder.

10 g of poly(methyl acrylate/co-N,N,N-trimethyl-N-vinylbenzylammonium chloride) (ratio of methyl acrylate to vinylbenzylammonium chloride=1/1) was dissolved in 200 ml of water and the resulting solution was uniformly blended with 100 g of 10%-lime-treated gelatin. The mixture solution was uniformly coated on a paper support as laminated with a titanium dioxide dispersion-containing polyethylene to form a film thereon having a wet film thickness of 90 μm.

Further, a mixture solution comprising 6 g of guanidine carbonate, 16 ml of water, 20 g of 10%-gelatin, 4.8 ml of 1%-aqueous solution of 2-ethylhexyl succinate/-sodium sulfonate and 2 ml of 2%-aqueous solution of 2,4-dichloro-6-hydroxy-1,3,5-triazine was superposed thereon to form a layer having a wet film thickness of 30 μm. After drying, the desired dye-fixing material sample (D-2) having a mordant layer was obtained.

The light-sensitive material sample was imagewise exposed with a tungsten lamp at 2,000 lux for one second through a green filter. Afterwards, the thus exposed sample was processed in the same manner as Example 1, using the dye-fixing material sample (D-2). As a result, a negative magenta image was formed on the dye-fixing material. The density of the negative image was measured with Macbeth Reflection Densitometer (RD-519), and the results are shown in the following Table 2.

TABLE 2

| Sample No. | Silver Salt | Maximum Density | Minimum Density |
|---|---|---|---|
| 201* | Silver benzotriazole | 1.63 | 0.12 |
| 202 | Z-1 | 2.26 | 0.13 |
| 203 | Z-2 | 2.14 | 0.12 |
| 204 | Z-3 | 2.17 | 0.15 |
| 205 | Z-4 | 2.18 | 0.14 |

*comparative sample

Table 2 proves that the light-sensitive materials containing the silver salt of the pyrazolazole-type compound of the present invention rapidly formed images of high density with low fog.

EXAMPLE 3

The following first layer (lowermost layer) to the sixth layer (uppermost layer) were coated on a polyethylene terephthalate film support to obtain a multilayer color photographic light-sensitive material Sample No. (301).

| | |
|---|---|
| Sixth layer: | |
| Gelatin | 800 mg/m$^2$ |
| Hardener (*3) | 16 g/m$^2$ |
| Basic zinc carbonate | 500 mg/m$^2$ |
| Fifth layer (green-sensitive emulsion layer): | |
| Silver chlorobromide emulsion (Br 50 mole %) | 500 mg(Ag)/m$^2$ |
| Silver benzotriazole emulsion | 100 mg(Ag)/m$^2$ |
| Sensitizer dye (D-1) | $10^{-6}$ mole/m$^2$ |
| Hardener (*3) | 16 mg/m$^2$ |
| Yellow-dye donor compound (B) | 400 mg/m$^2$ |
| Gelatin | 1,000 mg/m$^2$ |
| High-boiling solvent (*4) | 800 mg/m$^2$ |
| Surfactant (*2) | 100 mg/m$^2$ |
| Fourth layer (intermediate layer): | |
| Gelatin | 900 mg/m$^2$ |
| Hardener (*3) | 18 mg/m$^2$ |
| Basic zinc carbonate | 400 mg/m$^2$ |
| Third layer (red-sensitive emulsion layer): | |
| Silver chlorobromide emulsion (Br 80 mole %) | 400 mg(Ag)/m$^2$ |
| Silver benzotriazole emulsion | 100 mg(Ag)/m$^2$ |
| Sensitizer dye (D-2) | $8 \times 10^{-7}$ mole/m$^2$ |
| Hardener (*3) | 18 mg/m$^2$ |
| Magenta-dye donor compound (A) | 400 mg/m$^2$ |
| Gelatin | 1,000 mg/m$^2$ |

-continued

| | |
|---|---|
| High-boiling solvent (*1) | 600 mg/m$^2$ |
| Surfactant (*2) | 100 mg/m$^2$ |
| Second layer (intermediate layer): | |
| Gelatin | 800 mg/m$^2$ |
| Hardener (*3) | 16 mg/m$^2$ |
| Basic zinc carbonate | 450 mg/m$^2$ |
| First layer (infrared-sensitive emuslsion layer): | |
| Silver chlorobromide emulsion (Br 50 mole %) | 300 mg(Ag)/m$^2$ |
| Silver benzotriazole emulsion | 100 mg(Ag)/m$^2$ |
| Sensitizer dye (D-3) | $10^{-8}$ mole/m$^2$ |
| Hardener (*3) | 16 mg/m$^2$ |
| Cyan-dye donor compound (C) | 300 mg/m$^2$ |
| Gelatin | 1,000 mg/m$^2$ |
| High-boiling solvent (*4) | 600 mg/m$^2$ |
| Surfactant (*2) | 100 mg/m$^2$ |
| Support | |

Notes:
(*1) Tricresyl phosphate (*2) 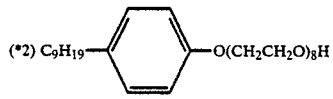

(*3) 1,2-bis(vinylsulfonylacetamido)ethane
(*4) $(isoC_9H_{19}O)_3P{=}O$

The preparation of the silver halide emulsions for the fifth layer and the first layer is described hereunder.

600 ml of an aqueous solution containing sodium chloride and potassium bromide and a silver nitrate-aqueous solution (prepared by dissolving 0.59 mole of silver nitrate in 600 ml of water) were added at the same time to a well-stirred gelatin-aqueous solution (prepared by dissolving 20 g of gelatin and 3 g of sodium chloride in 1,000 ml of water kept at 75° C.), in the course of 40 minutes and at the same flow speed. Thus, a mono-disperse cubic silver chlorobromide emulsion (bromide content: 50 mole%) having an average particle size of 0.40 μm was obtained.

After washing with water and demineralizing, 5 mg of sodium thiosulfate and 20 mg of 4-hydroxy-6-methyl-1,3,3a,7-tetrazaindene were added to the emulsion and chemical sensitization was conducted at 60° C. The yield of the emulsion was 600 g.

The preparation of the silver halide emulsion and the silver benzotriazole emulsion for the third layer was the same as that in Example 1.

Next, the preparation of a gelatin-dispersion containing a dye donor compound is described hereunder.

5 g of yellow-dye donor compound (B), 0.5 g of 2-ethylhexyl succinate-sodium sulfonate (as a surfactant) and 10 g of tri-isononyl phosphate were weighed, and 30 ml of ethyl acetate was added thereto and dissolved under heat at about 60° C. to obtain a uniform solution. The resulting solution was blended with 100 g of 10%-solution of a lime-treated gelatin, while stirred, and then the resulting mixture was homogenized in a homogenizer for 10 minutes at a rotation speed of 10,000 rpm to obtain a dispersion. This dispersion was called a yellow-dye donor dispersion.

In the same manner as above, with the exception that the magenta-dye donor compound (A) in Example 1 was used and that 7.5 g of tricresyl phosphate was used as the high boiling point solvent, a magenta-dye donor dispersion was obtained.

(B)

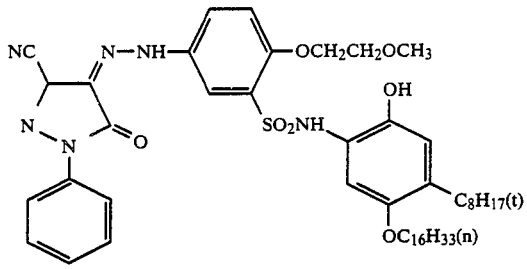

(C)

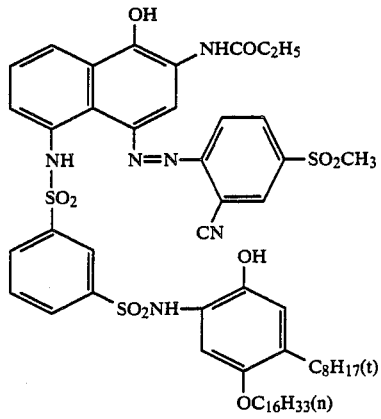

D-1

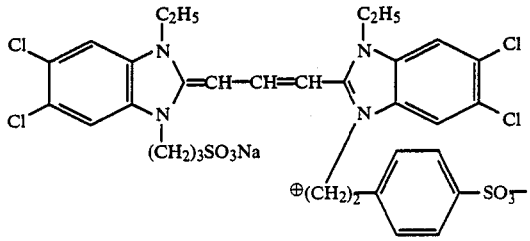

D-2

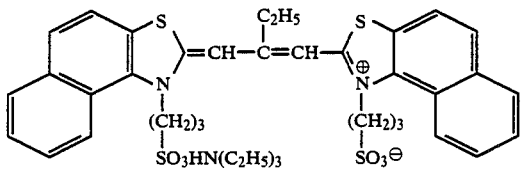

-continued

D-3

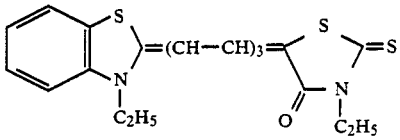

The multi-layer color photographic light-sensitive material was exposed to a tungsten lamp at 500 lux for one second through a G-R-IR three-color separation-filter composed of a 500 to 600 nm band-pass-filter for G, a 600 to 700 nm band-pass-filter for R, and a filter to pass 700 nm or more for IR, the color density in the filter continuously varying.

Light-sensitive material Sample Nos. 302, 323, 304 and 305 were prepared in the same manner as the preparation of Sample No. 301 except that the silver salts of the pyrazolazole-type compound (Z-1), (Z-2), (Z-3) and (Z-4) of the present invention, which were prepared in Example 1, were each added to the coating solutions for the first, third and fifth layers in an amount of the coated silver of 100 mg/m$^2$ in place of the silver benzoltriazole emulsion.

Afterwards, 20 ml/m$^2$ of water was applied to the surface of the emulsion layer of the thus exposed sample with a wire-bar, and then, this was attached to the same dye-fixing material sample (D-1) as Example 1, whereupon the surfaces of the coated layers of the both samples faced to each other. This was heated with a heat-roller for 15 seconds or 20 seconds while the temperature of the wetted film was regulated to be from 90° to 95° C., and thereafter, the dye-fixing material was peeled off from the light-sensitive material. Thus, yellow, magenta, and cyan color-images were formed on the dye-fixing material, corresponding to the G-R-IR-separation filters, respectively. The maximum density (Dmax) and the minimum density (Dmin) of each of the formed color-images were measured with Macbeth Reflection Densitometer (RD-519). The results are given in the following Table 3.

TABLE 3

| Sample No. | Silver salt | Processed time (sec) | $D_{max}$ Yellow | $D_{max}$ Magenta | $D_{max}$ Cyan | $D_{min}$ Yellow | $D_{min}$ Magenta | $D_{min}$ Cyan |
|---|---|---|---|---|---|---|---|---|
| 301* | — | 15 | 0.8 | 0.7 | 0.5 | 0.10 | 0.11 | 0.10 |
| | | 20 | 1.7 | 1.6 | 1.6 | 0.11 | 0.12 | 0.11 |
| 302 | (Z-1) | 15 | 1.9 | 2.3 | 2.4 | 0.11 | 0.12 | 0.12 |
| | | 20 | 2.1 | 2.3 | 2.4 | 0.14 | 0.13 | 0.13 |
| 303 | (Z-2) | 15 | 1.7 | 2.0 | 2.2 | 0.11 | 0.10 | 0.12 |
| | | 20 | 1.8 | 2.1 | 2.3 | 0.12 | 0.11 | 0.12 |
| 304 | (Z-3) | 15 | 1.9 | 2.2 | 2.1 | 0.12 | 0.12 | 0.12 |
| | | 20 | 2.1 | 2.3 | 2.3 | 0.14 | 0.13 | 0.14 |
| 305 | (Z-4) | 15 | 1.9 | 2.0 | 2.2 | 0.13 | 0.12 | 0.13 |
| | | 20 | 2.1 | 2.2 | 2.3 | 0.14 | 0.14 | 0.14 |

*comparative sample

Table 3 proves that the light-sensitive material containing the silver salt of the pyrazolazole-type compound of the present invention rapidly formed images of high density with low fog.

EXAMPLE 4

The following first layer (lowermost layer) to the sixth layer (uppermost layer) were coated on a polyethylene terephthalate film support to obtain a multilayer color photographic light-sensitive material, Sample No. (401).

| | |
|---|---|
| Sixth layer: | |
| Gelatin | 1,000 mg/m$^2$ |
| Base precursor (*3) | 600 mg/m$^2$ |
| Hardener (*6) | 100 mg/m$^2$ |
| Silica (*5) | 100 mg/m$^2$ |
| Fifth layer )green-sensitive emulsion layer): | |
| Silver chlorobromide emulsion (Br 50 mole %) | 400 mg(Ag)/m$^2$ |
| Benzenesulfonamide | 180 mg/m$^2$ |
| Silver benzotriazole emulsion | 100 mg(Ag)/m$^2$ |
| Sensitizer dye (D-1) | $10^{-6}$ mole/m$^2$ |
| Base precursor (*3) | 500 mg/m$^2$ |
| Yellow-dye donor compound (B) | 400 mg/m$^2$ |
| Gelatin | 1,000 mg/m$^2$ |
| High-boiling solvent (*4) | 800 mg/m$^2$ |
| Surfactant (*2) | 100 mg/m$^2$ |
| Fourth layer (intermediate layer): | |
| Gelatin | 1,200 mg/m$^2$ |
| Base precursor (*3) | 600 mg/m$^2$ |
| Third layer (red-sensitive emulsion layer): | |
| Silver chlorobromide emulsion (Br 80 mole %) | 300 mg(Ag)/m$^2$ |
| Benzenesulfonamide | 180 mg/m$^2$ |
| Silver benzotriazole emulsion | 100 mg(Ag)/m$^2$ |
| Sensitizer dye (D-2) | $8 \times 10^{-7}$ mole/m$^2$ |
| Base precursor (*3) | 450 mg/m$^2$ |
| Magenta-dye donor compound (A) | 400 mg/m$^2$ |
| Gelatin | 1,000 mg/m$^2$ |
| High-boiling solvent (*1) | 600 mg/m$^2$ |
| Surfactant (*2) | 100 mg/m$^2$ |
| Second layer (intermediate layer): | |
| Gelatin | 1,000 mg/m$^2$ |
| Base precursor (*3) | 600 mg/m$^2$ |
| First layer (infrared-sensitive emulsion layer): | |
| Silver chlorobromide emulsion (Br 50 mole %) | 300 mg(Ag)/m$^2$ |
| Benzenesulfonamide | 180 mg/m$^2$ |
| Silver benzotriazole emulsion | 100 mg(Ag)/m$^2$ |
| Sensitizer dye (D-3) | $10^{-8}$ mole/m$^2$ |
| Base precursor (*3) | 500 mg/m$^2$ |
| Cyan-dye donor compound (C) | 300 mg/m$^2$ |
| Gelatin | 1,000 mg/m$^2$ |
| High-boiling solvent (*4) | 600 mg/m$^2$ |
| Surfactant (*2) | 100 mg/m$^2$ |
| Support | |

Notes:
(*1) Tricresyl phosphate
(*2)

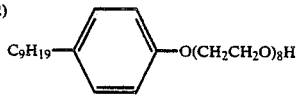

(*3) Guanidine 4-acetylaminophenyl-propiolate
(*4) $(iso C_9H_{19}O)_3P{=}O$
(*5) average diameter: 4 μm
(*6) 1,2-bis(vinylsulfonylacetamido)ethane The silver halide emulsions in the fifth layer and the first layer were the same as those in Example 3; and the silver halide emulsion in the third layer was the same as that in Example 1.

The preparation of the silver benzotriazole emulsion was the same as that in Example 1.

The preparation of the gelatin-dispersions of the dye donor compounds (B), (A), and (C) was the same as thats in Example 3.

Next, the preparation of dye-fixing material sample (D-3) is described hereunder.

10 g of poly(methyl acrylate/co-N,N,N-trimethyl-M-vinylbenzylammonium chloride) (ratio of methyl acrylate to vinylbenzylammonium chloride=1/1) was dissolved in 200 ml of water, and the resulting solution was uniformly blended with 100 g of 10%-lime-treated gelatin. The mixture solution was uniformly coated on a paper support as laminated with a titanium dioxide dispersion-containing polyethylene to form a layer having thereon a wet film thickness of 90 μm. After drying, this was used as the dye-fixing material sample (D-3) with a mordant layer.

The multi-layer color photographic light-sensitive material was exposed to a tungsten lamp of 500 lux for one second through a G-R-IR three-color separation-filter composed of a 500 to 600 nm band-pass filter for G, a 600 to 700 nm band-pass filter for R, and a filter to pass 700 nm or more for IR, the color density in the filter continuously varying.

Light-sensitive material Sample Nos. 402, 403, 404 and 405 were prepared in the same manner as the preparation of Sample No. 401 except that the silver salts of the pyrazolazole-type compound (Z-1), (Z-2), (Z-3) and (Z-4) of the present invention, which were prepared in Example 1, were each added to the coating solutions for the first, third and fifth layers in an amount of the coated silver of 100 mg/m$^2$ in place of the silver benzotriazole emulsion.

These light-sensitive material Samples (401) to through (405) were heated on a heat block as heated at 150° C. for 5 seconds or 15 seconds.

Afterwards, 20 ml/m$^2$ of water was applied to the surface of the emulsion layer of the dye-fixing material sample (D-3), and this was attached to the above light-sensitive material sample, which has been heated, whereupon the surfaces of the coated layers of the both samples faced to each other. This was heated on a heat block at 80° for 6 seconds, and then the dye-fixing material was peeled off from the light-sensitive material. Thus, yellow, magenta, and cyan color-images were formed on the dye-fixing material, corresponding to the G-R-IR-separation filter, respectively. The maximum density (Dmax) and the minimum density (Dmin) of each of the formed color-images were measured with Macbeth Reflection Densitometer (RD-519). The results are shown in the following Table 4.

TABLE 4

| Sample No. | Silver salt | Developed time (sec) | $D_{max}$ Yellow | $D_{max}$ Magenta | $D_{max}$ Cyan | $D_{min}$ Yellow | $D_{min}$ Magenta | $D_{min}$ Cyan |
|---|---|---|---|---|---|---|---|---|
| 401* | — | 5 | 0.6 | 0.5 | 0.4 | 0.10 | 0.11 | 0.10 |
| | | 15 | 1.7 | 1.6 | 1.7 | 0.11 | 0.12 | 0.11 |
| 402 | (Z-1) | 5 | 1.8 | 2.2 | 2.3 | 0.10 | 0.12 | 0.11 |
| | | 15 | 2.0 | 2.3 | 2.4 | 0.13 | 0.14 | 0.13 |
| 403 | (Z-2) | 5 | 1.7 | 2.1 | 2.1 | 0.11 | 0.10 | 0.11 |
| | | 15 | 1.9 | 2.3 | 2.2 | 0.13 | 0.12 | 0.12 |
| 404 | (Z-3) | 5 | 1.8 | 2.2 | 2.1 | 0.10 | 0.11 | 0.12 |
| | | 15 | 2.0 | 2.3 | 2.4 | 0.13 | 0.13 | 0.14 |
| 405 | (Z-4) | 5 | 1.8 | 2.1 | 2.2 | 0.12 | 0.13 | 0.13 |

TABLE 4-continued

| Sample No. | Silver salt | Developed time (sec) | $D_{max}$ Yellow | $D_{max}$ Magenta | $D_{max}$ Cyan | $D_{min}$ Yellow | $D_{min}$ Magenta | $D_{min}$ Cyan |
|---|---|---|---|---|---|---|---|---|
| | | 15 | 2.0 | 2.2 | 2.3 | 0.14 | 0.14 | 0.14 |

*comparative sample

Table 4 proves that the light-sensitive materials containing the silver salt of the pyrazolazole-type compound of the present invention rapidly form images of high density with low fog.

EXAMPLE 5

The preparation of a light-sensitive silver bromide-containing silver benzotriazole emulsion is described hereunder.

6.5 g of benzotriazole and 10 g of gelatin were dissolved in 1,000 ml water. The solution was stirred while kept at 50° C. Next, a solution of 8.5 g of silver nitrate as dissolved in 100 ml of water was added to the resulting solution in the course of 2 minutes.

Next, a solution of 1.2 g of potassium bromide as dissolved in 50 ml of water was added thereto in the course of 2 minutes. The pH value of the resulting emulsion was properly regulated for sedimentation to remove the excess salt. Next, the pH value of the emulsion was adjusted to 6.0. The yield of the emulsion was 200 g.

The preparation of a dye donor compound-containing gelatin-dispersion is described hereunder.

10 g of a dye donor compound having the following structural formula, 0.5 g of 2-ethylhexyl succinate-sodium sulfonate (as a surfactant), and 4 g of tri-cresyl phosphate (TCP) were weighed, and 20 ml of cyclohexanone was added thereto and dissolved under heat at about 60° C., to obtain a uniform solution.

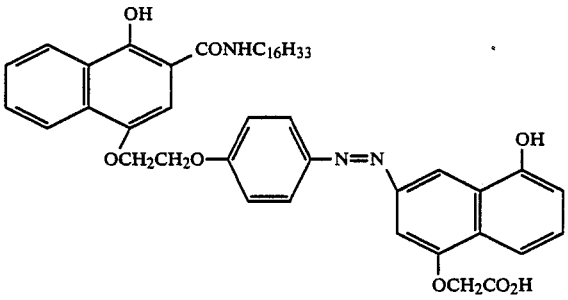

This solution was blended with 100 g of 10%-solution of lime-treated gelatin, while stirred, and then, the resulting mixture was homogenized in a homogenizer for 10 minutes at a rotation speed of 10,000 rpm to obtain a dispersion.

Next, the preparation of a light-sensitive layer-coated material is described below.

| | |
|---|---|
| (a) Light-sensitive silver bromide-containing silver benzotriazole emulsion | 10 g |

-continued

| | |
|---|---|
| (b) Dye donor compound-containing dispersion | 3.5 g |
| (c) Gelatin (10%-aqueous solution) | 5 g |
| (d) Solution of 0.2 g of 2,6-dichloro-4-aminophenol as dissolved in 2 ml of methanol | |
| (e) 10%-aqueous solution of the following compound: | 1 ml |

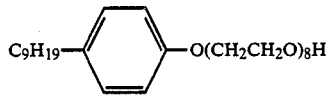

The above (a) through (e) were blended and dissolved under heat, and the resulting solution was coated on a polyethylene terephthalate film having a thickness of 180 μm, to form a layer thereon having a wet film thickness of 30 μm.

Next, a coating composition for a protective layer was prepared as follows:

Coating composition for protective layer:

| | |
|---|---|
| (f) 10%-gelatin | 400 g |
| (g) Basic zinc carbonate (10%-aqueous dispersion) | 150 g |
| (h) 4%-aqueous solution of the following hardener $CH_2{=}CH{-}SO_2CH_2CONH{-}(CH_2)_2{-}NHCOCH_2SO_2{-}CH{=}CH_2$ | 50 ml |

The above (f) through (h) were blended and a tackifier and water were added thereto to obtain a solution of 1,000 ml. The thus obtained coating composition was superposed on the previously coated light-sensitive layer to form a protective layer thereon having a thickness of 30 μm.

The light-sensitive material thus obtained was labeled as light-sensitive material Sample No. (501).

In the same manner as the preparation of Sample No. (501) with the exception that an emulsion of the organic silver salt (Z-1) containing a light-sensitive silver bromide, which had been prepared as described below, was used in place of the light-sensitive silver bromide-containing silver benzotriazole emulsion in Sample (501), another light-sensitive material Sample No. (502) was obtained.

9.5 g of compound No. (22) of the present invention and 10 g of gelatin were dissolved in 300 ml of ethanol and 1,000 ml of water. The solution was stirred, while being kept at 50° C. Next, a solution of 8.5 g of silver nitrate dissolved in 100 ml of water was added to the above solution in the course of 2 minutes.

Next, a solution of 1.2 g of potassium bromide as dissolved in 50 ml of water was added to the resulting solution in the course of 2 minutes. The pH value of the resulting emulsion was properly regulated for sedimentation to remove the excess salt. Afterwards, the pH of the emulsion was adjusted to 6.0. The yield of the emulsion was 200 g.

These light-sensitive material Sample Nos. (501) and (502) were imagewise exposed with a tungsten lamp at 2,000 lux for 10 seconds. Afterwards, the thus exposed samples were processed in the same manner as Example 1, and a negative magenta-color image was formed on each dye-fixing material. The density of the negative image was measured with Macbeth Reflection Densitometer (RD-519), and the results are shown in the following Table 5.

TABLE 5

| Sample No. | Processed Time (sec) | Maximum Density | Minimum Density |
|---|---|---|---|
| 501 | 15 | 0.65 | 0.14 |
| (comparison) | 20 | 1.16 | 0.16 |
| 502 | 15 | 1.97 | 0.17 |
| (invention) | 20 | 2.21 | 0.18 |

Table 5 proves that the light-sensitive material containing the silver salt of the pyazolazole-type compound of the present invention rapidly formed an image of high density with low fog.

EXAMPLE 6

The preparation of a dye donor compound-containing gelatin-dispersion is described hereunder.

20 ml of cyclohexanone was added to 5 g of a reducible dye-releasing agent having the following indicated structural formula, 4 g of an electron donor compound having the following indicated structural formula, 0.5 of 2-ethylhexyl succinate-sodium sulfonate, and 10 g of tricresyl phosphate (TCP) and dissolved under heat at about 60° C.

Dye-releasing agent:

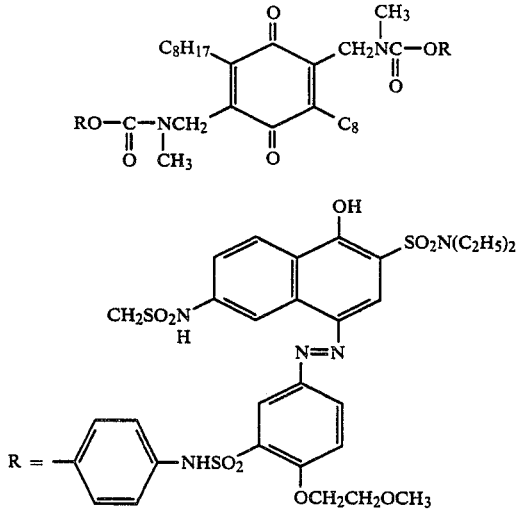

Electron donor compound:

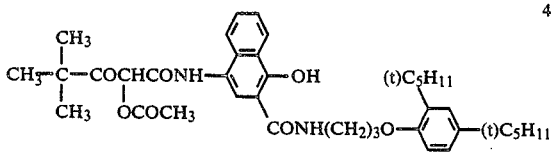

4 g

The resulting solution was blended with 100 g of 10%-gelatin solution, while stirring, and then the resulting solution was homogenized in a homogenizer for 10 minutes at a rotation speed of 10,000 rpm, to obtain a dispersion.

Next, the preparation of a light-sensitive layer-coated material is described below.

| | | |
|---|---|---|
| (a) | Light-sensitive silver bromide-containing silver benzotriazole emulsion (as described in Example 4) | 10 g |
| (b) | Dye donor compound-containing dispersion | 3.5 g |
| (c) | 5%-aqueous solution containing the following compound | 1.5 ml |

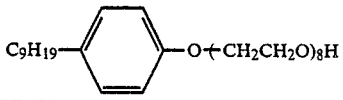

The above (a) through (c) were blended and dissolved under heat, and the resulting solution was coated on a polyethylene terephthalate film to form thereon a layer having a wet film thickness of 30 μm, which was then dried.

Next, the following composition was superposed on the layer to form thereon a protective layer having a wet film thickness of 30 μm, which was then dried. Thus, a light-sensitive material Sample No. (601) was obtained.

Protective layer composition:

| | | |
|---|---|---|
| (d) | Gelatin (10%-aqueous solution) | 30 g |
| (e) | Basic zinc carbonate (10%-aqueous dispersion) | 15 g |
| (f) | 4%-aqueous solution of the following hardener $CH_2{=}CHSO_2CH_2CONHCH_2CH_2NHCOCH_2SO_2CH{=}CH_2$ | 8 ml |
| (g) | Water | 47 ml |

In the same manner as the preparation of Sample No. (601) with the exception that the emulsion of Example 5, which contained the light-sensitive silver bromide and the organic silver salt (Z-1), was used in place of the light-sensitive silver bromide-containing silver benzotriazole emulsion in Sample No. (601), another light-sensitive material Sample No. (602) was prepared.

These light-sensitive material Sample Nos. (601) and (602) were imagewise exposed with a tungsten lamp at 2,000 lux for 10 seconds. Afterwards, the thus exposed samples were processed in the same manner as Example 1, using the same dye-fixing material. Thus, a positive magenta-color image was formed on each dye-fixing material. The density of the positive image was measured with a Macbeth Reflection Densitometer (RD-519), and the results are shown in the following Table 6.

TABLE 6

| Sample No. | Processed Time (sec) | Maximum Density | Minimum Density |
|---|---|---|---|
| 601 | 15 | 0.76 | 0.19 |
| (comparison) | 20 | 1.66 | 0.22 |
| 602 | 15 | 1.91 | 0.17 |
| (invention) | 20 | 2.20 | 0.20 |

Table 6 proves that in the formation of positive images, the light-sensitive material containing the silver salt of the present compound rapidly forms a positive image of high density with low fog.

From the above results, the beneficial effects of the present invention are apparent.

While the invention has been described in detail and with reference to specific embodiments thereof, it will be apparent to one skilled in the art that various changes and modifications can be made therein without departing from the spirit and scope thereof.

What is claimed is:

1. A heat-developable photographic light-sensitive material comprising, on a support, at least a light-sensitive silver halide, a binder, a reducing agent, and an organic silver salt, wherein said organic silver salt is a silver salt of a pyrazolazole-type compound wherein the pyrazolazole-type compound is selected from compounds of formulae (II), (III), (IV), (V), (VI) (VII), and (VIII)

(II)

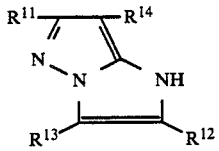

(III)

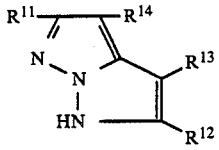

(IV)

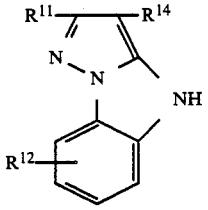

(V)

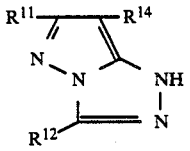

(VI)

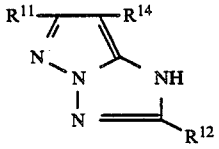

(VII)

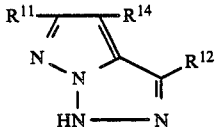

(VIII)

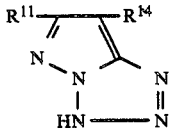

wherein $R^{11}$, $R^{12}$, $R^{13}$, and $R^{14}$ each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; or $R^{12}$ and $R^{13}$ in formula (III) together form a 5-membered to 7-membered ring.

2. A heat-developable photographic light-sensitive material as in claim 1, wherein $R^{11}$ and $R^{14}$ of formula (I) each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

3. A heat-developable photographic light-sensitive material as in claim 1, wherein the pyrazolazole-type compound is a compound represented by formula (VI).

4. A heat-developable photographic light-sensitive material as in claim 1, wherein the pyrazolazole-type compound represented by formula (I) is present in an amount of from 0.01 to 200 moles per mole of the light-sensitive silver halide.

5. A heat-developable photographic light-sensitive material as in claim 1, wherein the amount of silver salt represented by formula (I) is from 0.01 to 200 moles per mole of the light-sensitive silver halide.

6. A heat-developable photographic light-sensitive material as in claim 3, wherein the pyrazolazole-type compound of formula (VI) is present in an amount of from 0.01 to 200 moles per mole of the light-sensitive silver halide.

7. A heat-developable photographic light-sensitive material as in claim 1, additionally comprising a dye donor compound.

8. A heat-developable photographic light-sensitive material as in claim 7, wherein the dye donor compound is represented by formula ($L_1$)

$$(\text{Dye-X})_n\text{-Y} \qquad (L_1)$$

wherein Dye represents a dye group or a dye precursor group whose wavelength is shortened temporarily; X represents a chemical bond or a divalent linking group; and Y represents a group which either causes an image-wise differential in the diffusibility of the compound $(\text{Dye-X})_n$-Y in correspondence or reverse correspondence with the photosensitive silver salt carrying a latent image or releases the Dye and causes a differential in diffusibility between the released Dye and $(\text{Dye-X})_n$-Y; n represents 1 or 2.

* * * * *